United States Patent [19]

Frazier et al.

[11] Patent Number: 4,834,942

[45] Date of Patent: May 30, 1989

[54] ELEVATED TEMPERATURE ALUMINUM-TITANIUM ALLOY BY POWDER METALLURGY PROCESS

[75] Inventors: William E. Frazier; Michael J. Koczak, both of Philadelphia, Pa.

[73] Assignee: The United States of America as represented by the Secretary of the Navy, Washington, D.C.

[21] Appl. No.: 150,122

[22] Filed: Jan. 29, 1988

[51] Int. Cl.[4] ..... C22C 21/00

[52] U.S. Cl. ..... 420/552; 75/233; 75/249; 148/11.5 P; 148/437; 419/66; 419/67; 419/68; 419/69

[58] Field of Search ..... 148/415, 437, 11.5 P; 420/552; 75/233, 249; 419/62, 66, 67, 68, 69

[56] References Cited

U.S. PATENT DOCUMENTS 3,462,248 8/1969 Roberts et al. ..... 420/552

*Primary Examiner*—R. Dean

*Attorney, Agent, or Firm*—John M. O'Meara; Susan E. Verona

[57] ABSTRACT

An aluminum-titanium alloy and a process of making it, the alloy consisting essentially of aluminum, 4–6 wt. % titanium, 1–2 wt. % carbon, and 0.1–0.2 wt % oxygen. The alloy is an aluminum matrix supersaturated with titanium, and having throughout a fine, homogeneous dispersion of $Al_3Ti$ particles. It is fine grained and has grain boundary dispersoids of carbides and oxides, predominantly of aluminum. An aluminum-titanium melt is rapidly solidified and then mechanically alloyed in the presence of a carbon-bearing agent. The resulting powder is degassed and hot consolidated to form articles which exhibit high strength, ductility, and creep resistance at temperatures greater than 200° C.

30 Claims, No Drawings

ELEVATED TEMPERATURE ALUMINUM-TITANIUM ALLOY BY POWDER METALLURGY PROCESS

STATEMENT OF GOVERNMENT INTEREST

The invention described herein may be used by and for the Government of the United States of America for governmental purposes without the payment of any royalties thereon or therefor.

BACKGROUND OF THE INVENTION

This invention relates generally to aluminum alloys and more particularly to aluminum-titanium alloys produced using powder metallurgy techniques.

Advanced aircraft require utilization of materials which are not only lightweight but retain structural strength at temperatures between 150° C. and 300° C. State-of-the art elevated temperature aluminum alloys currently used for this application are composed of large quantities of transition elements, such as Fe, Mo and V. These elements form thermally stable intermetallics in the aluminum which resist coarsening because the elements have low solid state solubilities and low diffusivities. However, such heavy transition elements increase the alloy's density, an undesirable effect.

Titanium, on the other hand, is relatively lightweight and is currently used in small quantities (0.01–0.20 wt. %) as a grain refiner in cast and wrought aluminum alloys. However, alloys containing $\geqq$ 0.5 wt. % titanium have not been used for structural applications such as aircraft because conventional casting techniques result in a microstructure consisting of coarse $Al_3Ti$ particulates embedded in the aluminum matrix. These large intermetallics degrade the strength and ductility of the aluminum.

Rapid solidification technology is a well-known powder metallurgy technique which provides unique structures, morphologies, and metastable phases. It has been used to create aluminum alloys using transition elements, resulting in the desired fine microstructure. Rapid solidification has not been successfully used in the presence of carbon, however because the carbon is virtually insoluble in the aluminum and agglomerates before the process can be completed. It is therefore not possible to produce carbides using rapid solidification processing alone.

Mechanical alloying is another well-known powder metallurgy technique which involves the process of repeatedly fracture-and-cold welding a powder to produce a strong atomistic bond between unlike elements. Aluminum alloys produced using this technique have excellent high temperature mechanical properties due to the fine dispersion of aluminides, carbides, and oxides distributed in their microstructures. Mechanical alloying has been attempted using elemental aluminum and titanium powders and reasonable mechanical strength was obtained but ductility suffered. This was caused by the presence of large $Al_3Ti$ intermetallics and alloy inhomogeneity. Mechanical alloying alone can not refine and homogenize the size and distribution of $Al_3Ti$.

No attempt has been made to combine the processes of rapid solidification and mechanical alloying, because the benefits of doing so have not become apparent.

SUMMARY OF THE INVENTION

An object of the present invention is to provide an elevated temperature aluminum alloy containing as primary alloying elements titanium, carbon, and oxygen.

Another object is to use powder metallurgy techniques to produce an aluminum-titanium alloy.

Yet another object is to provide a low density, high modulus, high strength material for use in advanced high performance aerospace applications.

Briefly, these and other objects are accomplished by producing a prealloyed aluminum-titanium powder by using rapid solidification technology, such as helium gas atomization, and further mechanically alloying the prealloyed powder to produce an aluminum-titanium powder. This powder is then hot consolidated to produce an alloy comprised of fine homogeneously distributed $Al_3Ti$ particles throughout an aluminum matrix supersaturated with titanium. The alloy also has carbides and oxides such as $Al_4C_3$ and $Al_2O_3$ in the grain boundaries. The resulting consolidated alloy may be further processed in any conventional manner to produce articles which exhibit high strength, ductility, and creep resistance at temperatures greater than 200° C.

Other objects, advantages and novel features of the invention will become apparent from the following detailed description of the invention.

DESCRIPTION OF THE PREFERRED EMBODIMENT

The present invention provides a low density aluminum-titanium alloy which exhibits high structural strength and ductility at elevated temperatures. The optimum weight percentage range for each compositional element in the alloy is as follows: 4–6 wt. % titanium (Ti), 1–2 wt. % carbon (C), 0.1–0.2 wt. % oxygen (O), balance aluminum (Al), with trace amounts of other impurities acceptable. The alloy is an aluminum matrix supersaturated with titanium, and having throughout its fine grain structure a fine, homogeneous dispersion of $Al_3Ti$ particles. It also contains dispersoids in the grain boundaries and throughout the matrix of carbides and oxides, predominantly of aluminum, but also of titanium and of any trace elements that may be present, such as V, Ce, Ta, or Sc. The quantitative microstructural description of the alloy is shown in Table I.

TABLE I

Quantitative Microstructral Description of the Alloy

| Compound | Particle Diameter, μm | Volume Fraction | Location |
|---|---|---|---|
| $Al_3Ti$ | 0.10 | 0.1–0.2 | homo. disp. |
| $Al_4C_3$ | 0.01 | 0.04–0.08 | grain bound.* |
| $Al_2O_3$ | 0.01 | 1–2 | grain bound.* |
| Al | 0.4+ | balance | matrix |

+grain size
*predominantly

The alloy's microstructure provides several beneficial effects. For instance, there are two dominant strengthening mechanisms operating in the alloy. One is a grain size strengthening mechanism performed primarily by the carbides and oxides in the alloy, particularly the aluminum carbides and oxides, which strengthen by maintaining the fine grain size. The other is a particle strengthening mechanism, performed by the carbides and oxides as well as by the $Al_3Ti$ dispersoids. The dispersoids in the grain boundaries also inhibit grain boundary sliding by inhibiting diffusion or motion of dislocation in the grain boundaries, which results in good creep resistance. This counters the normally poor creep resistance associated with fine grain size. Also, the homogeneity of the dispersions provides uniformity of properties.

In accordance with the present invention, the aluminum-titanium alloy is made in the following manner. A melt of aluminum and 4 to 6 wt. % titanium is first rapidly solidified, such as by helium gas atomization, at a cooling rate of at least $10^4$° C./sec, the faster the rate the better. Such a process is described in F. V. Lenel, *Powder Metallurgy Principles and Applications*. Metal Power Industries Federation, Princeton, N.J., 1980, Chap. 2. This process produces a prealloyed first powder consisting of fine (less than 0.1 micrometer diameter) $Al_3Ti$ dispersoids homogeneously distributed in a supersaturated solid solution of aluminum and titanium. A cooling rate $\geqq 10^4$° C./sec is important to produce the fine $Al_3Ti$ particles which are important for strength and ductility. The high cooling rate used in the rapid solidification process also acts to trap some of the titanium in solid solution aluminum. The more titanium retained in solid solution the better, because the retained titanium will eventually precipitate as even finer $Al_3Ti$ particles upon aging.

The prealloyed powder which results from the rapid solidification process is then mechanically alloyed, for instance by high energy ball milling or attrition. Mechanical alloying is an excellent means of producing a reasonably homogeneous powder from mixed elemental powders. The prealloyed powder is ball milled in a sealed attritor wherein steel balls impelled by rotating paddles repeatedly impact the powders, causing them to cold weld. It is done in the presence of a carbon-bearing process control agent such as stearic acid. This agent performs two functions: it provides the carbon which forms the carbides in the alloy, and it prevents the powder from agglomerating into a solid glob during the process. Stearic acid is a particularly desirable agent for this latter function because it is solid at room temperature and waxy and therefore acts as a lubricant. The amount of stearic acid used should be an amount sufficient to provide the desired weight percent of carbon in the alloy, essentially all of the carbon in the stearic acid being consumed in the mechanical alloying process. For a 4 wt. % titanium alloy, 1 wt. % stearic acid would be preferable, and for a 6 wt. % titanium alloy the preferred amount would be 1½ wt. %. During the process the oxide layer inherently present on the powder's surface is fractured upon impact. Oxides are dispersed into the material along with the carbon-bearing compound. New oxides regenerate on the fresh surface and the process is repeated. Mechanical alloying is performed until the powder's minimum fineness is achieved, which is determined by monitoring the process and periodically checking the mesh. The result is a heavily cold worked second powder of a homogeneous composition and having a uniform dispersion of submicron amorphous oxides and carbides.

To process the powder further into useful articles the powder is first vacuum degassed at a temperature of between 400° and 450° C. Degassing is done to remove the moisture and volatile gases that develop during milling. In the best mode of operation of the invention, the degassed powder is then vacuum hot pressed at between 450° and 550° C. Although it is not necessary, hot pressing allows the particles to bond better and puts the powder in better form for the hot working which follows. Hot working is performed at between 375° and 425° C. and can be any hot working process such as hot isostatic pressing, extrusion, rolling, or forging. During this hot consolidation the amorphous carbide and oxide particles react to form a fine dispersion of 0.01 micrometer diameter $Al_4C_3$ and $Al_2O_3$. In addition, fine particles of titanium carbide and titanium oxide may form at this stage. Other carbides and oxides may form if other elements are prealloyed in the starting powder. Annealing the aluminum-titanium alloys at 300° C. for 100 hours is optional and increases strength. The increase in strength is attributable to the precipitation of $Al_3Ti$ and the formation of $Al_4C_3$ and $Al_2O_3$.

The invention may best be illustrated by the following example wherein a tensile specimen was produced according to the invention and then tested for various properties. The results are described in Tables II, III, and IV.

The specimen was an Al-6 wt. % Ti alloy. A melt of the Al-Ti mixture was helium gas atomized and screened to −325 mesh (−44μm) powder. The powder was then mechanically alloyed in a high energy ball mill in the presence of 1½ wt. % stearic acid. The resulting powder combination was then cold pressed into a 10 Kg billet 0.15 m in diameter and vacuum degassed at 427° C. The billet was then enclosed or canned in 1100 series aluminum powder and vacuum hot pressed at 493° C. and 34 MPa. The canning material was then removed and the billet was heated to a nominal temperature of 410° C., transferred to a container at 316° C. and extruded at a ratio of 47:1 into a 22 mm diameter rod, from which a test specimen was made. The tested specimen indicated that the mechanical properties of the alloy: strength, ductility, and creep resistance, are retained at temperatures greater than 200° C. The alloy's ambient temperature and elevated temperature mechanical properties are reported in Tables II and III. The alloy also exhibits excellent creep resistance. Table IV presents the creep response of the alloy measured at temperatures between 220° and 280° C. The creep is logarithmic; therefore, creep rate continually decreases with time.

TABLE II

| Ambient Temperature Mechanical Properties | |
|---|---|
| Ultimate Tensile Strength | 351.3 MPa |
| Yield Strength | 320.9 MPa |
| Elongation | 9.0% |
| Young's Modulus, E | 86.7 GPa |
| Notch Tensile Strength/ Ultimate Tensile Strength | 1.25 |

TABLE III

| Elevated Temperature Mechanical Properties | | | | |
|---|---|---|---|---|
| | Alloy Test Temperature | | | |
| Property | 20° C. | 200° C. | 300° C. | 400° C. |
| Yield Strength, MPa | 320.9 | 245.8 | 195.8 | 97.7 |
| Tensile Strength, MPa | 345.7 | 254.6 | 200.6 | 98.1 |
| % Elongation | 9.5 | 5.0 | 4.0 | 2.7 |

TABLE IV

| Temperature, °C. | Stress, MPa | Creep Rate, ($s^{-1} \times 10^9$) |
|---|---|---|
| 220 | 138 | 4.2 |
| 250 | 138 | 4.6 |
| 280 | 138 | 8.7 |
| 220 | 172 | 9.2 |
| 250 | 172 | 18.7 |

TABLE IV-continued

| Temperature, °C. | Stress, MPa | Creep Rate, ($s^{-1} \times 10^9$) |
|---|---|---|
| 280 | 172 | 63.4 |

More details concerning the experimental procedures and test results are available in G. S. Murty, M. J. Koczak, and W. E. Frazier, "High Temperature Deformation of Rapid Solidification Processed/Mechanically Alloyed Al-Ti Alloys", Scripta Metallurgica Vol. 21, 1987, pp. 141–146, incorporated by reference herein.

Some of the many features and advantages of the invention should now be readily apparent. For example an aluminum-titanium alloy particularly useful for advanced aerospace systems has been provided which demonstrates good structural strength at elevated temperatures such as between 200° and 300° C. which is a 100° C. improvement over conventional aluminum alloys such as 7075, 6061, and 2024. Also, an aluminum-titanium alloy produced by powder metallurgy techniques has been provided which exhibits a low density (2.76–2.80 g/cm$^3$) and a 25% higher modulus than conventional aluminum alloys, e.g. 85 GPa.

Other embodiments and modifications of the present invention may readily come to those of ordinary skill in the art having the benefit of the teachings of the foregoing description. For example, alternative combinations of compositions are shown in Table V.

TABLE V

| Alternative Alloy Composition Ranges (Wt. %) | | | |
|---|---|---|---|
| Ti | C | O | Al |
| 3–20 | 0.5–2.5 | 0.05–4.0 | balance* |

*with ternary additions e.g. V, Ce, Ta, Sc

In terms of processing, the rapid solidification process may include any of a number of commercial processes with cooling rates of $10^4$° C./s or greater. Such processes include planar flow casting and roller quenching. The mechanical alloying process may include a variety of high energy ball milling or attrition processes in which alloy powders are repeatedly fracture-and-cold welded. Additionally the process control agent may be any of a variety of carbon-bearing agents other than stearic acid, such as heptane. Any conventional consolidation processing technique may be used on the powder. For instance the vacuum hot pressing step is not a requirement; the alloy powder may be directly consolidated by hot isostatic pressing, extrusion, rolling, or forging. It is also envisioned that rapid solidification and mechanical alloying could be combined in producing other aluminum powder alloys, as well as alloys of copper, nickel, and iron.

What is claimed is:

1. An aluminum-titanium alloy exhibiting high strength at high temperatures and consisting essentially of, by weight, 3 to 20% titanium, 0.5 to 2.5% carbon, 0.05 to 4.0% oxygen, balance aluminum and other trace elements, said aluminum alloy being the product of a process comprising the steps of:

preparing a melt of aluminum and 3 to 20 weight percent titanium;

rapidly solidifying the melt at greater than or equal to $10^4$° C./sec to form a first powder;

mechanically alloying the first powder in the presence of a sufficient amount of a carbon-bearing process control agent to provide the desired percent of carbon in said alloy, thereby producing a second powder;

degassing said second powder at between 400° C. and 450° C. to remove moisture and volatile gases; and hot consolidating said degassed second powder at between 375° C. and 425° C.

2. An aluminum-titanium alloy as in claim 1, the process further comprising the step of hot pressing said degassed second powder at between 450° C. and 550° C. before said hot consolidating step.

3. An aluminum-titanium alloy as in claim 2, the process further comprising the steps of enclosing said degassed powder in a can of 1100 series aluminum before hot pressing and removing said can before hot consolidating.

4. An aluminum-titanium alloy as in claim 1 the process further comprising the step of annealing said hot consolidated powder at less than or equal to 300° C. for about 100 hours.

5. An aluminum-titanium alloy as in claim 1 wherein said hot consolidating step is performed by extrusion.

6. An aluminum-titanium alloy as in claim 1 wherein said hot consolidating step is performed by hot isostatic pressing.

7. An aluminum-titanium alloy as in claim 1 wherein said hot consolidating step is performed by rolling.

8. An aluminum-titanium alloy as in claim 1 wherein said hot consolidating step is performed by forging.

9. An aluminum-titanium alloy as in claim 1 wherein said process control agent is stearic acid.

10. An aluminum-titanium alloy exhibiting high strength at high temperatures and consisting essentially of, by weight, 4 to 6% titanium, 1 to 2% carbon, 0.1 to 0.2% oxygen, balance aluminum and other trace elements, said aluminum alloy being the product of a process comprising the steps of:

preparing a melt of aluminum and 4 to 6 weight percent titanium;

rapidly solidifying the melt at greater than or equal to $10^4$° C./sec to form a first powder;

mechanically alloying the first powder in the presence of a sufficient amount of a carbon-bearing process control agent to provide the desired percent of carbon in said alloy, thereby producing a second powder;

degassing said second powder at between 400° C. and 450° C. to remove moisture and volatile gases; and hot consolidating said degassed second powder at between 375° C. and 425° C.

11. An aluminum-titanium alloy as in claim 10, the process further comprising the step of hot pressing said degassed second powder at between 450° C. and 550° C. before said hot consolidating step.

12. An aluminum-titanium alloy as in claim 11, the process further comprising the steps of enclosing said degassed powder in a can of 1100 series aluminum before hot pressing and removing said can before hot consolidating.

13. An aluminum-titanium alloy as in claim 10 the process further comprising the step of annealing said hot consolidated powder at less than or equal to 300° C. for about 100 hours.

14. An aluminum-titanium alloy as in claim 10 wherein said hot consolidating step is performed by extrusion.

15. An aluminum-titanium alloy as in claim 10 wherein said hot consolidating step is performed by hot isostatic pressing.

16. An aluminum-titanium alloy as in claim 10 wherein said hot consolidating step is performed by rolling.

17. An aluminum-titanium alloy as in claim 10 wherein said hot consolidating step is performed by forging.

18. An aluminum-titanium alloy as in claim 10 wherein said process control agent is stearic acid.

19. An aluminum-titanium powder produced by a process comprising the steps of:

preparing a melt of aluminum and 3 to 20 weight percent titanium;

rapidly solidifying the melt at greater than or equal to $10^{4}$° C./sec to form a first powder; and mechanically alloying the first powder in the presence of a sufficient amount of a carbon-bearing process control agent to provide 0.5 to 2.5 weight percent carbon in said powder.

20. An aluminum-titanium powder as in claim 19 wherein the melt prepared has 4 to 6 weight percent titanium and the powder is provided with 1 to 2% carbon.

21. A process of making an aluminum-titanium alloy said process comprising the steps of:

preparing a melt of aluminum and 3 to 20 weight percent titanium;

rapidly solidifying the melt at greater than or equal to $10^{4}$° C./sec to form a first powder;

mechanically alloying the first powder in the presence of a sufficient amount of a carbon-bearing process control agent to provide 0.5 to 2.5 weight percent carbon in said alloy, thereby producing a second powder;

degassing said second powder at between 400° C. and 450° C. to remove moisture and volatile gases; and hot consolidating said degassed second powder at between 375° C. and 425° C.

22. The process of claim 21 wherein the melt prepared has 4 to 6 weight percent titanium and the alloy is provided with 1 to 2% carbon.

23. The process of claim 22, further comprising the step of hot pressing said degassed second powder at between 450° C. and 550° C. before said hot consolidating step.

24. The process of claim 23, further comprising the steps of enclosing said degassed powder in a can of 1100 series aluminum before hot pressing and removing said can before hot consolidating.

25. The process of claim 22, further comprising the step of annealing said hot consolidated powder at less than or equal to 300° C. for about 100 hours.

26. The process of claim 22, wherein said hot consolidating step is performed by extrusion.

27. The process of claim 22, wherein said hot consolidating step is performed by hot isostatic pressing.

28. The process of claim 22, wherein said hot consolidating step is performed by rolling.

29. The process of claim 22, wherein said hot consolidating step is performed by forging.

30. The process of claim 22 wherein said process control agent is stearic acid.

* * * * *